US005410861A

United States Patent [19]

Medlock

[11] Patent Number: 5,410,861

[45] Date of Patent: May 2, 1995

[54] APPARATUS FOR BANDING BUNCHED ARTICLES

[76] Inventor: Harold G. Medlock, Box 7514 U.S. Highway 85, Fort Lufton, Colo. 80621-8824

[21] Appl. No.: 46,222

[22] Filed: Apr. 13, 1993

[51] Int. Cl.[6] ..... B65B 13/04; B65B 27/10

[52] U.S. Cl. ..... 53/586; 53/137.2

[58] Field of Search ..... 53/399, 419, 137.2, 53/586, 228, 229, 373.5, 374.4, 375.4, 553

[56] References Cited

U.S. PATENT DOCUMENTS

| | | | |
|---|---|---|---|
| Re. 26,553 | 3/1969 | Nutting et al. | 53/374.4 X |
| 2,540,430 | 2/1951 | Cornock et al. | 53/229 |
| 2,627,893 | 2/1953 | Williams | 53/374.4 X |
| 4,041,672 | 8/1977 | Gularte | 53/399 |
| 4,232,498 | 11/1980 | Uchida . | |
| 4,341,057 | 7/1982 | Limousin | 53/586 X |
| 4,604,852 | 8/1986 | Becker | 53/553 X |
| 4,665,679 | 5/1987 | Watanabe | 53/586 X |
| 4,718,220 | 1/1988 | Van Rosendal et al. | 53/137.2 X |
| 4,949,846 | 8/1990 | Lakey | 53/374.4 X |

*Primary Examiner*—Linda B. Johnson

[57] ABSTRACT

Method and apparatus for banding groups of elongated items, including a conveyor for propelling trough-like carriers of groups of items to be banded. Each group of items passes through two sets of rotating spoked wheels positioned two above the conveyor and two below the conveyor with the two upper spoked wheels positioned in spaced relationship to one another so as to position one over each of the two oppositely disposed ends of the groups of items and over the lower spoked wheels. The spoked wheels are timed so that spoke tips of the upper wheels will contact spoke tips of the lower wheels as the ends of the grouped items pass between the spokes. Each of the spoked wheels carries a continuous strip of banding material spanning across the tips of the spokes. As the carriers pass the groups through the spokes of the wheels, the banding material is laid over the top and the bottom surfaces of each end of the grouped items, and the upper and lower spokes are brought together to draw the banding material tightly across the top and bottom of the items, whereat contact between the top and bottom banding material strips is made and secured, such as with adhesive, so as to define a loop of banding wrapped tightly around each of the ends of the bundled items. Cutting blades then sever the contacting and affixed top and bottom banding strip, thus separating the connected bundles into individual units.

2 Claims, 4 Drawing Sheets

APPARATUS FOR BANDING BUNCHED ARTICLES

BACKGROUND OF THE INVENTION

1. Field of the Invention

The present invention is an improved apparatus and method for binding bunched pluralities of elongated items and securing the bunches of elongated items into individual bundles with banding material. The elongated items specifically referred to and given for example in this disclosure are asparagus shoots bunched and secured in small bundles for boxing and shipment to grocery stores.

2. Description of the Prior Art

In preparing fresh vegetables such as asparagus, celery, broccoli and the like for market, it is a common and desirable practice to bind a plurality of the vegetables together in bundles for ease of handling and protection of the produce. Such meal or family size bundles of vegetables are usually bound with wire or plastic ties or elastic bands. Non resilient ties have the disadvantage of often cutting into the soft and delicate produce, or being so loose as to not adequately bind the individual items securely in a group. Elastic bands require stretching and the individual application of the closed loop over the produce ends which necessitates a lot of manual labor. Adhesive tape has been widely used for enclosing plastic bags and packages containing produce, but has up this time not been widely used to bind the loose produce into bundles. One device which does bind a thermally adhesive tape around articles such as produce is taught in U.S. Pat. No. 4,232,498, issued to H. Uchida on Nov. 11, 1980. This device uses a continuous roll of thermally adhesive tape to bind groups of articles together. Basically, each group of articles is pressed into the center of a length of tape, followed by the tape being brought around the grouped items so that the tape defines an encircling loop. The tape is brought around the group and brought together where it is sealed onto itself on the other side of the group of articles. This procedure is time consuming in that each group of articles must be manually inserted into the taping device one at a time, and then taped and removed from the taping apparatus. This procedure requires essentially starting and stopping, or forward and then rearward movement of the items being bundled. The tape is cut with each bundle which essentially renders the system a non-continuous process.

Although many of the problems of produce bundling have been solved by prior art devices, there is yet to be provided a fast, automated or semi-automated, simple yet reliable apparatus for tightly banding groups of produce in a non-damaging manner.

SUMMARY OF THE INVENTION

The present invention provides a fast, generally automatic continuous bundling apparatus and method primarily for elongated produce items such as asparagus. With the present invention, the bundles are tightly bound to prevent individual items from slipping from the bundles, and the banding is non-damaging to the produce.

A structural embodiment of the invention includes a motor powered endless loop of conveyor chain supporting and propelling a plurality of relatively short item carriers or troughs affixed transversely to the conveyor chain and in spaced relationship to one another.

Each carrier is sized and positioned for holding the central area of a group of items positioned lengthwise transverse to the conveyor chain, and leaving the two oppositely disposed ends of the elongated items extending and circumfentially exposed beyond the oppositely disposed terminal ends of the relatively short carrier. Each group of items within the moving carriers passes through two sets of rotating spoked wheels positioned with two spoked wheels above the conveyor and two spoked wheels below the conveyor. The two upper spoked wheels are positioned in spaced relationship to one another and one on each side of the conveyor chain so as to position one spoked wheel over each of the two oppositely disposed exposed ends of the groups of items as the items pass through the spokes the wheels. The two lower spoked wheels are positioned one directly beneath each of the two upper spoked wheels. The rotating spoked wheels are timed to each other and to the movement of the conveyor chain so that spoke tips of the upper wheels will contact spoke tips of the lower wheels adjacent each terminal end of the carriers as the carriers pass centrally between the two upper spoked wheels. As the carriers holding the items are passed centrally between the two upper spoked wheels by the moving conveyor chain, the ends of the items within the carriers and extending beyond the terminal ends of the carriers are passed into and between two spokes of each of the upper and lower rotating spoked wheels. Each of the spoked wheels carries a continuous strip of flexible banding material payed out from a reel, one reel per each spoked wheel so that with rotation of the spoked wheels, banding may be continuosly fed from the reels to the spokes. The feeding of the banding material from the reels to the spoked wheels is preferably timed and power assisted so that the banding material is stretched tightly across from one spoke to another on a wheel. The banding material is positioned on the ends of the spokes. As the carriers pass the groups through the spokes of the wheels, due to the timed rotation speed of the spoked wheels relative to the movement of the conveyor along with the proper spacing between each spoke of the wheels, banding material is placed over the top and the bottom surfaces of each opposite end of the grouped items. The ends of the upper and lower spokes are brought together via timed rotation to draw the banding material tightly across the top and bottom of the grouped items between the spokes, and since the banding was taunt and extending straight across the spokes in the first place, the banding material must bow around the grouped items in the carrier, and this has the effect of drawing the items tightly together. The top and bottom banding material is brought together in contact by the bringing together of the spokes. At the time and at the point at which the banding material is contacted one to another, the banding material is affixed together, such as with pressure sensitive adhesive or other suitable affixments such as heat or sonic welding or possibly even mechanical fasteners such as clips. The bringing together and affixing of the banding material defines a tight loop of banding wrapped around each of the oppositely disposed ends of the bundled items. Cutting blades, also timed, then sever the contacting and affixed top and bottom banding strip in the approximate center of the affixment point which is ½ to 1 inch in length, thus separating the connected bundles into individual units. The process is continuous since the cutting of the banding occurs after the banding of the groups of items and the movement of the banded group away from the banding applicator wheels (spoked wheels). The individual items are then carried further where they are dumped or ejected from the carriers, usually onto a conveyor belt to be carried to a boxing station where the bundles are suitably boxed for shipping.

Washing of the produce may be employed either before or after the bundle if desired. With produce such as asparagus and broccoli which has a desirable and edible head or tip, the aligning of the heads should occur at some point prior to the carriers passing the items in between the spokes for tight banding. Also with produce such as asparagus and broccoli, it is most often desirable to cut or trim the ends of the stalks opposite the heads or tips. Although the end trimming may be employed at any suitable point in the process, it has been found that trimming of the ends of the bundle usually works best after binding, thus producing an attractive even ended bundle, and for this purpose, an end cutting blade such as a band saw or rotary blade may be installed adjacent the conveyor chain so the ends of each bundle may be trimmed while still stabilized in the carriers and preferably after the tight banding has occurred. Certain processes or steps are applicable to certain elongated items and non-applicable to others, while some are desirable but non-essential.

One major advantage of this apparatus is that the carriers holding the elongated items need not stop for the application of the banding or cutting of the banding, which greatly speeds up the production process. The procedure, after insertion of the elongated items into the carriers, is completely automated. The placement of the elongated items into the carriers could of course also be automated if desired, or may be manual.

These and other objects and advantages of the present invention will become more apparent to those skilled in the art with reading of the following detailed description which is illustrated in different views in the accompanying drawings.

BEST MODE FOR CARRYING OUT THE INVENTION

Figure 1:
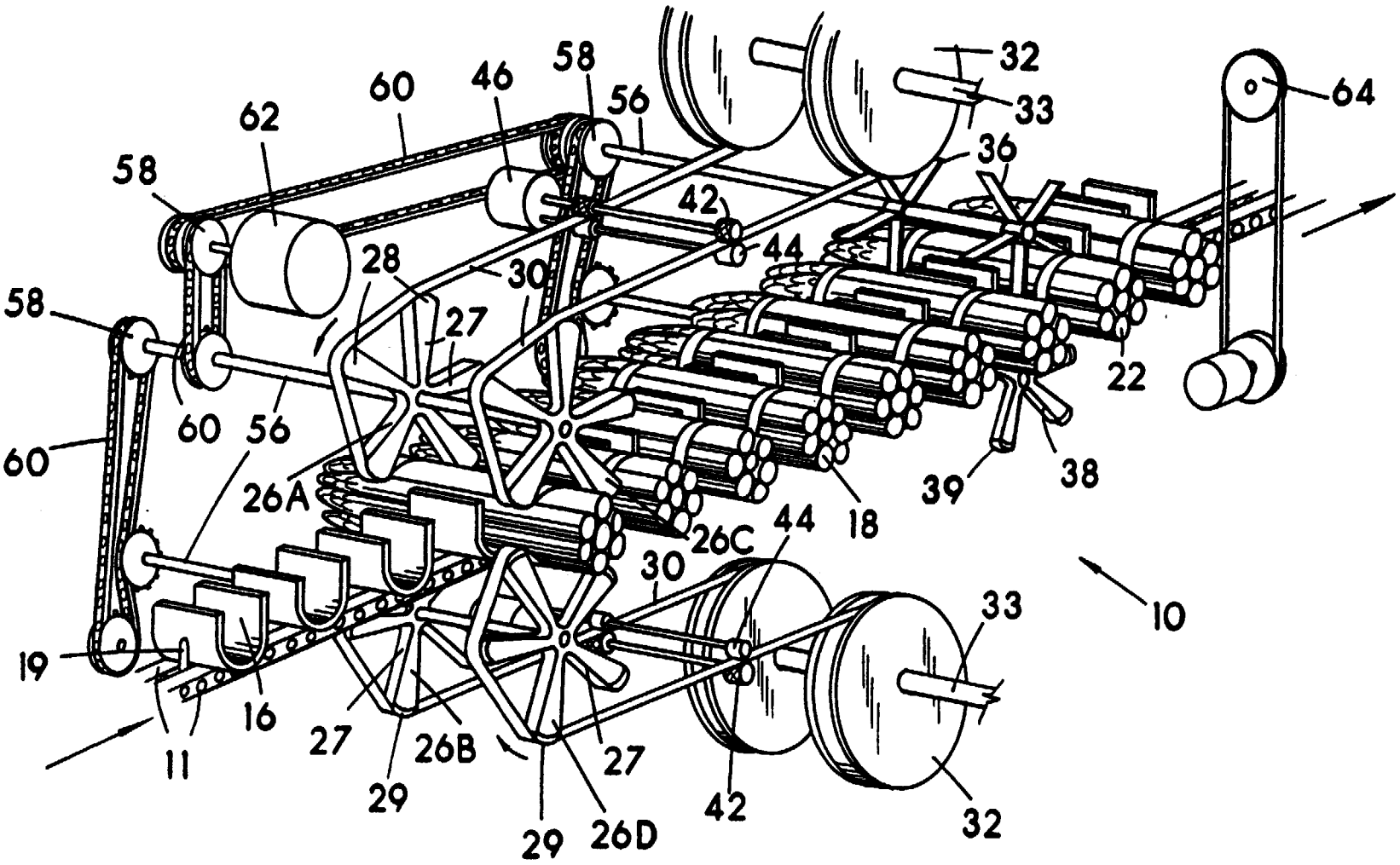
FIG. 1 is a top perspective view of a structural embodiment of the present invention.

Referring now to the drawings where a preferred structural embodiment of the present invention is illustrated and designated as bundle banding apparatus 10. Apparatus 10 in the drawings is arranged for the continuous banding of asparagus shoots into individual meal or family sized bundles 24 for example. With asparagus, it is generally preferable to apply two bands to each bundle, one band adjacent each of the oppositely disposed ends of the elongated vegetables, and thus dual or two sets of banding spoked wheels 26 are shown in the drawings and described in this disclosure. However with some elongated items such as broccoli one band applied centrally or just on one end may be considered adequate. In order to apply one band only to an elongated group, it will be appreciated the only one set of spoked wheels 26 would be used. Additionally, it will be appreciated that if a single band was desired to place in the center of group of items, open space completely around the area where the banding is to be applied would be provided, and to this end the carriers 16 might be slit transversely centrally into effectively two adjacent carriers and used with just one set of spoked wheels 26. Apparatus 10 will however henceforth being generally be described as being structured for applying two bands to a single group of items using two sets of spoked wheels.

Apparatus 10 generally includes an elongated endless loop conveyor 12, which is chain conveyor in this example formed of dual conveyor chains 11 trained over endward support and drive sprockets 14. Dual conveyor chains 11 are preferred to provide increased stability to the transversely positioned carriers 16 which are attached to chains 11. Chains, as those skilled in the art will recognize can be used to help ensure timing and synchronization in a machine, a opposed to rubber belts which are more apt to slip out of timing. At least one sprocket 14 is coupled to a motor 13 or other suitable drive structure, which is preferably speed controllable, which drives or causes rotation in conveyor chains 11 as a unit where they move together, shown in the drawings in a clockwise direction for example. Conveyor 12, or at least the portions thereof which carry and support carriers 16 such as chains 11, is preferably positioned at an approximate 45 degree angle for ease of aligning ends of elongated items to be bundled using gravity as may be ascertained from FIG. 6 where small groups of individual asparagus 18 shoots are being manually loaded into carriers 16 which are at an angle. The tips 20 of the asparagus are being placed downward with the bottom ends 22 upward in the sloped or angled carriers 16. The tips 20 are resting on a conveyor 23 which provides a surface for the tips 20 to abut and for the asparagus to slide down against for alignment. Conveyor 23 could possibly be a slick and smooth surface, but in this case to reduce damage to produce is a powered conveyor belt set to rotate and move the surface on which the tips are resting at the same rate as the movement of carriers 16. The drive motor (not shown) for conveyor 23 is also preferably speed controllable. Tip alignment and thus the sloped carriers 16 are not always desirable with all elongated items which may be banded together with the present invention.

Figure 2:
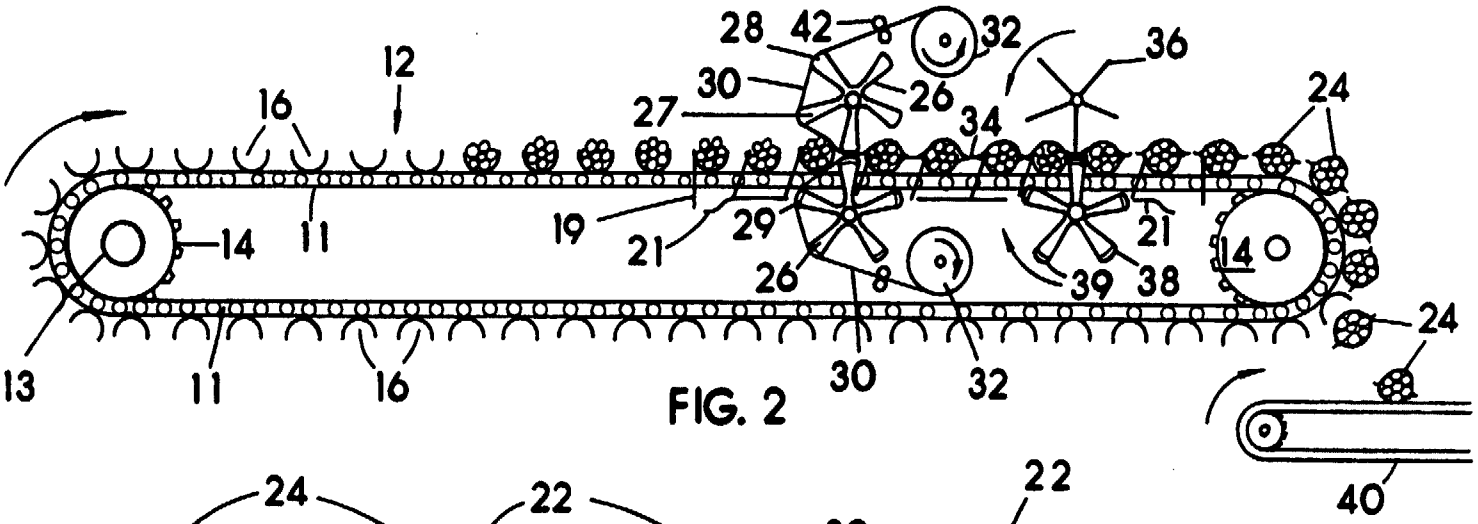
FIG. 2 is a partial side view of the embodiment of FIG. 1.
Figure 4:
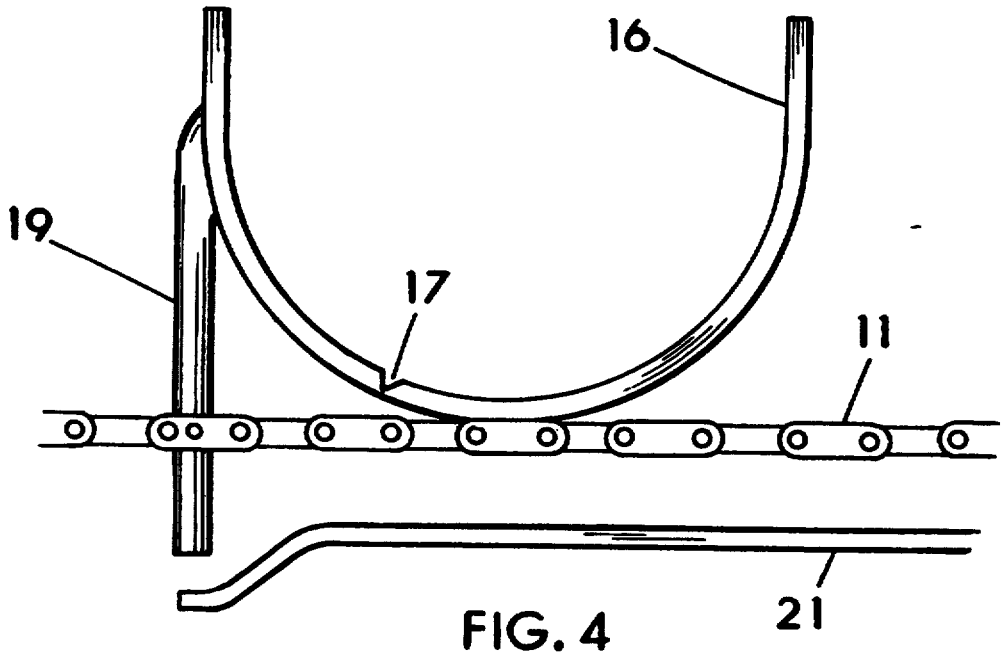
FIG. 4 is a side view of a carrier in an open position on the conveyor chain.
Figure 5:
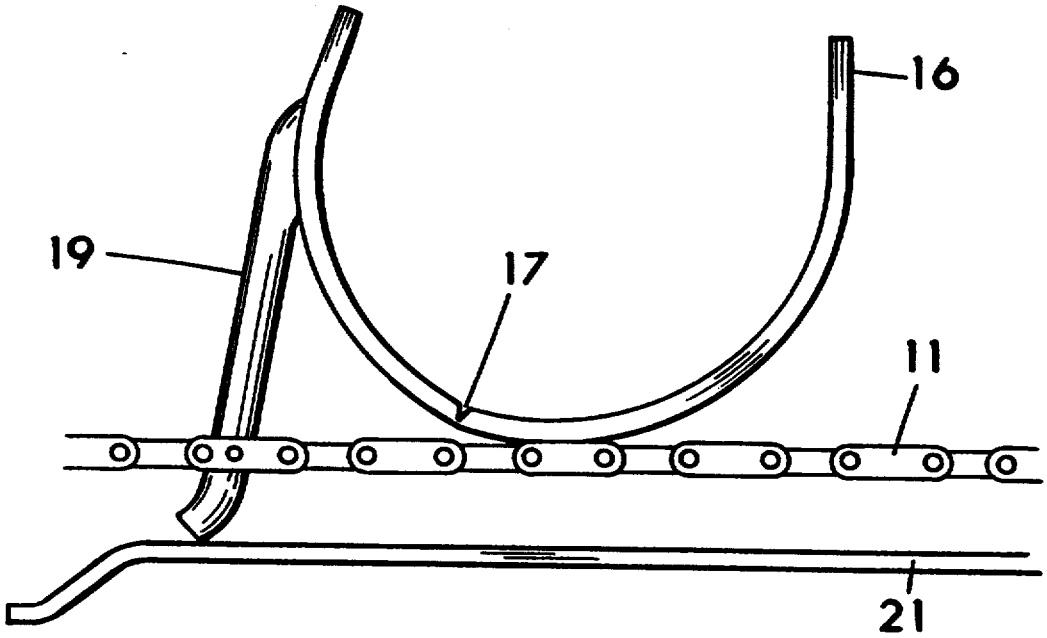
FIG. 5 is a side view of a carrier in a closed position on the conveyor chain.

Conveyor chains 11 are affixed with a plurality of transversely positioned carriers 16 placed in spaced relationship to one another along the entire length or loop of the chains 11 as may be seen in FIG. 2. Each carrier 16 is structured into a short semi-flexible and resilient U-shaped trough having an open top and two open ends, and preferably made of plastics. Each carrier 16 is affixed, preferably with bolts, to conveyor chains 11. Each carrier 16 includes a lengthwise living hinge 17 positioned off center which allows one side of carrier 16 to pivot inward. The pivotal side of carrier 16 is centrally inherently affixed to one end of an extending pin 19. The distal end of pin 19 extends down between the space between dual chains 11. Pin 19 is sufficiently stiff when pushed upon to bend the pivotal side of carrier 16 at living hinge 17 so as to pinch together the group of items within carrier 16 prior to a manipulation such as banding or sawing in order to provide increased stability and a more tight banding of a group of articles. Pin 19 is pushed or pivoted when the distal end is ramped up onto a ramped smooth plate 21 mounted beneath a portion of conveyor 12 in the area where banding or another manipulation is to be applied, wherein the distal end of pin 19 trails behind carrier 16, thus bending the pivotal side of carrier 16 inward, as shown in FIGS. 4 and 5. Carriers 16 are sized in length for supporting the central section of a group of elongated articles, such as asparagus 18, so as to leave circumferentially exposed areas at each opposite end of the articles for the banding.

Figure 6:
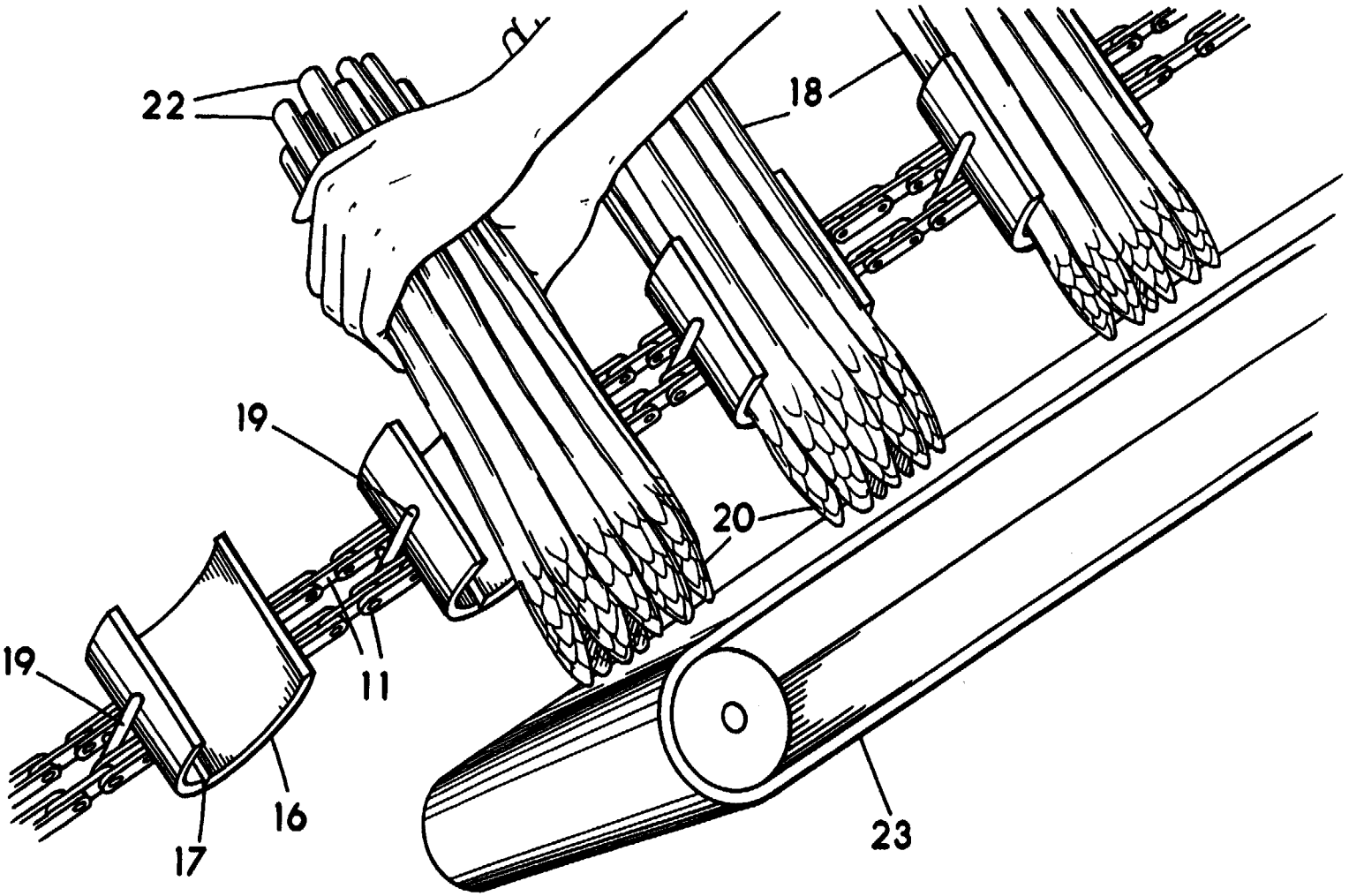
FIG. 6 is a view of the carriers being manually loaded with asparagus, and the ends being aligned.

Conveyor chains 11 are designed to transport carriers 16 sequentially past given points along the conveyor. One end of the conveyor 12 is considered a starting end where the carriers 16 are loaded with groups of asparagus as shown in FIG. 6. The loading occurs with the carriers 16 moving so the loading may be continuous. The loaded carriers 16 are sequentially moved toward the banding station which may be somewhat centrally placed in conveyor 12.

The banding station is best shown in FIGS. 1 and 2, and in this example generally comprises two sets of spoked wheels 26, four spoked wheels 26 for applying two bandings at once to the oppositely disposed ends of a single group of items in a carrier 16. The spoked wheels 26, which are sub-designated as A, B, C, and D are supported, rotated and timed (synchronized) with one another and timed to the conveyors 12 and 23 utilizing a motor 62 and a plurality of rotary shafts 56 with sprockets 58, jack shafts with sprockets to acquire proper direction rotations, and coupled together to each other and motor 62 with drive chains 60 in this example. It should be understood timing and proper direction of rotation are very important in this machine, and in order to achieve this, any number of known arrangements may be employed. Such arrangements may include using one motor of the entire machine or multiple motors. It is desirable to be able to speed up and slow down the machine at will without effecting the timing or synchronization. In FIG. 1, the two sets of spoked wheels are designated 26 A and 26 B which is a first set, and 26 C and 26 D as the second set, with each set for applying one band per set. Spoked wheels 26 A and C (not a set) are on a single same upper shaft 56 above conveyor 12, and spoked wheels 26 B and D (not a set) are on a separate single shaft 56 below conveyor 12 and each directly offset from their mate spoked wheel. The first set of 26 A and B is in this example identical to the second set of 26 C and D. The upper spoked wheels 26 A and C (not a set) in this example are each rigid or at least semi-rigid spoked wheels each having equal pluralities of radially extending spokes 27 affixed to a center hub attached to a single shaft 56. The spoked wheels 26 A and C are affixed stationary on the rotary shaft 56 and the spokes 27 of one spoked wheel are aligned straight across laterally from the spokes 27 of the other as may be ascertained from the FIG. 1. Spoked wheels 26 A and C rotate together as a unit with rotation of the support shaft 56. The direction of rotation of spoked wheels 26 A and C is always such that the spokes 27 when rotating toward the conveyor 12, the spokes 27 will be moving in the same direction as the moving conveyor chain 11 as they approach the conveyor. Spoked wheel 26 A is positioned adjacent and above the conveyor and slightly beyond the adjacent terminal end of the carrier 16 so as to be positioned aligned over a circumferentially exposed area of the extending elongated items held within carrier 16. Spoked wheel 26 C is positioned adjacent and above the conveyor and slightly beyond the opposite adjacent terminal end of the carrier 16 from 26 A so as to be positioned aligned over the opposite circumferentially exposed area of the extending elongated items held within carrier 16, and on the other side of the conveyor chain 11 from wheel 26 A. In this example, both spoked wheels 26 A and C have rigid exposed spoke tips 28.

Spoked wheels 26 B and D (not a set) in this example are each rigid or at least semi-rigid spoked wheels each having equal pluralities of radially extending spokes 27 affixed to a center hub attached to a single shaft 56 below conveyor chain 11. The exposed spoke tips 29 of spoked wheels 26 B and D are preferably rendered soft such as with a rubbery plastic affixed thereon as will be understood with continued reading. The spoked wheels 26 B and D are affixed stationary on a rotary shaft 56 and the spokes 27 are aligned straight laterally across from one another as may be ascertained from the FIG. 1. As may be ascertained from FIGS. 1 and 2, the spokes of each set of spoked wheels are arranged affixed in their rotation so that the spoke tips of each of the two spoked wheels of the set, spokes of 26 A abut spokes of 26 B, and spokes of 26 C abut spokes of 26 D, followed by the abutment being broken and the next two adjacent spokes 27 abutting in a repetitious manner with synchronized rotation. Spoked wheels 26 B and D rotate together as a unit with rotation of the support shaft 56. Spoked wheel 26 B is positioned adjacent and below the conveyor and slightly beyond the adjacent terminal end of the carrier 16 so as to be positioned aligned under the circumferentially exposed area of the extending elongated items held within carrier 16 and directly offset across or below from its mate wheel 26 A. Spoked wheel 26 D is positioned adjacent and below the conveyor and to the opposite side of the conveyor from 26 B, and slightly beyond the adjacent terminal end of the carrier 16 so as to be positioned aligned under the circumferentially exposed area of the extending elongated items held within carrier 16 and directly offset across and below from its mate wheel 26 C.

The direction of rotation of spoked wheels 26 B and D is always such that the spokes 27 when rotating toward the conveyor 12 they will be moving in the same direction as the moving conveyor chain 11 as they approach the conveyor. In this example, spoked wheels 26 A and C rotate in one direction, and spoked wheels 26 B and D rotate in the opposite direction due to their relative placement of being either above or below conveyor chain 11. Each spoked wheel 26 rotates at the same speed as the other spoked wheels 26, or in other words are synchronized to one another and to the rate of movement conveyor chain 11 and thus carriers 16.

Each of the spokes 27 of each spoked wheel 26 is sized and space on a given wheel 26 so as to provide a spaced distance between the spokes and specifically between the spoke tips 28 or 29 depending upon the wheel. The spokes 27 on a given wheel 26 are spaced equidistance from one another. The space between the spokes on a given wheel 26, and the number of spokes for that matter, needs to be specific to the spacing between carriers 16 on chains 11 and to the anticipated approximate major circumferal diameter of the groups of items to be banded. As shown in FIG. 1, the spacing between the ends of the spokes needs to be such that the spoke tips of two adjacent spokes on a given wheel may in part straddle or span across or be on two side of a group of items within a carrier 16 with the group of items partly recessed up between the two adjacent spokes 27 as the items in the carrier 16 are passed lengthwise transversely through the rotating spokes 27 of the wheels 26. In examining FIG. 1, it can be seen that with continued rotation of spoked wheel 26 C and its mate wheel 26 D, a spoke tip of each of the wheels will be brought together in part due to the conveyor chain 11 moving the carrier 16 with elongated items through the center of the spokes and further along the conveyor and thus providing movement space for the rotating spoked wheels 26 C and D. These abutting spoke tips, as will be explained, will cause the bringing together of two separate strips of banding material.

Each spoked wheel 26 serves as support and applicator for directing a continuous length of flexible banding from a bulk supply of banding. In this example of the invention the banding is pressure sensitive adhesive tape 30 having adhesive applied to only one side and supplied from four separate bulk tape reels 32 support rotatably on shafts 33. Tape 30 is stretched tightly between each spoke tip of multiple spokes 27 on each wheel 26 as may be seen in FIG. 1. Each wheel 26 has its own supply of tape on a reel 32, with the adhesive side of the tape facing outward away from the spoke tip. Tape 30 is preferably somewhat elastic and resilient, and of non-toxic material allowed by the Food and Drug Administration. Each spoke 27 of the spoked wheels 26 is particularly adapted in length and space (as discussed above) for spanning over either the top or bottom surface of the grouped asparagus 18 contained in carriers 16. In operation, as the carrier 16 advances towards spoked wheels 26, the spokes 27 are timed to sufficiently allow extending asparagus in a carrier 16 to move in between the spokes 27 where with continued movement a strip of tape is laid across the top surface of the asparagus by the upper wheel 26 of a set, and a strip of tape is laid across the opposite bottom side of the asparagus by the mating lower wheel 26 of the set. When the spokes 27 abut, the two section of tape will contact one another and the spoke tip will pressure the pressure sensitive adhesives causing an affixment or seam 34. The soft or rubbery tips 29 of spoked wheels 26 B and D provide for assured pressure against the tape, without the possibly of equipment damaging pressures which could occur with two rigid surfaces in close tolerances. In effect, a seam 34 is first made at the front or close side of the group of asparagus as it begins to approach and enter between spokes 27, followed by the upper and lower sections of spaced apart tape 30 on the rotating spoked wheel 26 of a set being brought downward in effect reducing the spacing between the tape as the rotation occurs and the group of items move further in between the spokes 27, which is followed by the second seam 34 being made on the opposite side of the asparagus as it exits from between the spokes 27. In this example two bands are being applied at once, one band to each of the oppositely disposed ends of a group of asparagus, which is a situation where two seams 34 are formed simultaneously as the group approaches and enters the spokes 27, followed by two seams 34 as the group of item exits the spokes 27. It should be noted that when first initially starting the machine, a seam 34 needs to be manually formed on the exiting side of a group of items in part between the spokes 27 so as to secure the otherwise loose ends of the tape 30. After the initial start, the ends of the tape 30 are rendered secure by newly forming seams as the continuous banding process proceeds. In order to provide for tightly bound bundles, the closable carriers 16 should be in the "pinched" or closed position as discussed earlier, and elastic and resilient banding such as tape 30 should be employed, and further, the tape 30 should be rendered taut across the spoke tip of the wheels 26. The tape 30 may be best rendered taut and properly aligned using a tape guide system which both helps guide the tapes as it feed straight onto the rotating spokes 27, and also secure the tape 30 itself, not the reels 32. In FIG. 1, a motor 46 is shown, one motor 46 for the two upper spoked wheels 26, and one motor 46 for the two lower spoked wheel 26. Each motor 46 has a shaft which supports and rotates two spaced apart knurled wheel 42. A rotatable but non-power idler wheel 44 on a shaft is positioned adjacent each knurled wheel 42. Wheels 42 and 44 are positioned between the reel 32 of tape and the spoked wheel which the reel feeds. Wheels 42 and 44 serve as pinch wheels through which the tape 30 extends. The sticky side of the tape 30 faces the knurled wheel 42, for it is the knurling which prevents the tape from sticking. The idler wheel 44 presses against the back side of the tape 30, and the speed of rotation of motor 46 determines the automatic feed rate of the tape 30 to the spoke wheels 26, and thus the tape 30 may be maintained taut across the spoke tips as desired. The tautness of the "elastic" tape 30 across the tips of the spokes hold the tape from slipping, and during operation, when a group of items in part recesses in between two spokes 27, the already taut tape 30 is stretched into a bow shape over the items prior to the seam 34 being formed. After the seam 34 is formed, the elastic nature of the tape 30 causes it to secure the bundled item very securely.

Figure 3:
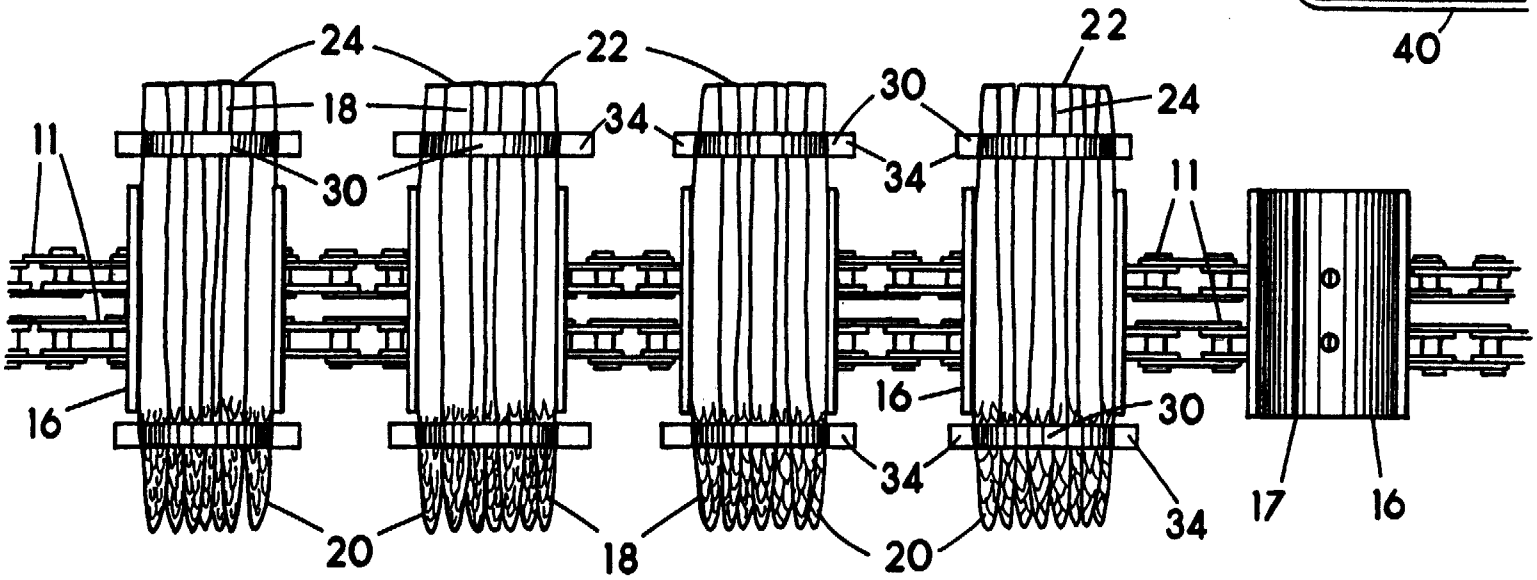
FIG. 3 is a top view of a section of the conveyor chain showing four carriers retaining bundled asparagus.

The seams 34 should be of a length sufficiently wide so that when the seam 34 is transversely severed in order to sever connected bundles into individual bundles 24, that the seam 34 may be cut leaving in tact a portion of the adhered seam on each side of the sever as may be better understood by looking at FIG. 3. In FIG. 3, the severing has already occurred, and the wide gap between the adjacent seams 34 is the result of the tape 30 springing back with its elasticity. These bundles 24 in FIG. 3 may be dropped off of the conveyor 12 as may be ascertained from FIG. 2 where the bundles are being dumped onto an off-load conveyor 40 at the turn in conveyor 12 to be carried to a boxing station (not shown).

The severing of the tape 30 at the seams 34 is preferably automated, and in FIGS. 1 and 2 two upper rotary cutting wheels 36 fashioned similar to spoked wheels 26 are shown. Cutting wheel 36 may be driven and timed much the same as spoked wheels 26. Cutting wheels 36 differ from spoked wheels in that sharp cutting blades are affixed to the spoke tips of cutting wheels 36 which when brought down in proper timing into the center of a seam 34, sever the seam 34 into two sections and thus the bundles are divided into separate individual bundles. Rotating and timed cutting anvils 38 are aligned under each cutting wheel 36 so as to provide a soft yet reasonably firm anvil for the cutting blade of wheel 36 to press against. The spoked tips 39 of cutting anvils 38 are soft so as to not damage and dull the cutting blades.

Although tape 30 is preferred to have one surface covered with an adhesive, tape 30 can also be a resilient non-adhesive heat bondable plastic wherein seam 34 could be created with heat or possibly sonic bonding wherein the spoke tips of wheel 26 may include heating elements and switch or possibly sonic bonding or welding equipment and on/off switches therefore. In this situation, electrical power would need to be fed into the rotating wheels 26 using electrical slip rings or brushes or some other suitable arrangement.

Although I have very specifically described the best mode for carrying out the invention, it should be understood that the specific details are given for example to those skilled in the art so they may be able to understand how to build and used the invention. Many changes in the specific structures and processes described may clearly be made without departing from the true scope of the invention, and therefore the invention is not to be unreasonably limited by the specifics in the afore writing and drawings given for example, but is to be determined by the spirit and scope of the appended claims.

What I claim as my invention is:

1. An apparatus for sequentially and tightly banding pluralities of elongated separate items into groups of items; comprising, a powered endless loop conveyor means, a plurality of item carriers in spaced relationship with one another along said conveyor means and attached to said conveyor means for movement by said conveyor means, said carriers each structured to hold a plurality of items to be banded into a single group, said carriers sized and shaped for holding the items with a portion of a group of items within each carrier exposed circumferentially so as to provide an exposed area for banding to be applied around each group of items, at least a first spoked wheel and a second spoked wheel, each spoked wheel having a plurality of radially extending spokes attached to a center hub of each spoked wheel, the spokes of said spoked wheels each having exposed spoke tips, said spoked wheels each connected to powering means for causing synchronized rotation in each of said spoked wheels with the synchronization of rotation being between both said first and second spoked wheels and additionally between movement in said conveyor means and said carriers attached to said conveyor means; said first spoked wheel positioned adjacent to and generally above said conveyor means, said second spoked wheel positioned adjacent to and generally below said conveyor means and offset across from said first spoked wheel, said spoked wheels positioned relative to each other so that with said synchronized rotation a spoke tip of said first spoked wheel is brought into contact with a spoke tip of said second spoked wheel followed by contact of the tips being broken and two adjacent spoke tips being brought into contact in a repetitious cycle with continued synchronized rotation of said first and second spoked wheels, said spokes of said first spoked wheel being sized and spaced from one another so as to provide a spaced distance between each of the spoke tips, with said spaced distance being sufficiently wide as to allow for at least the partial spanning by two adjacent spokes of said first spoked wheel over a group of elongated items held within a carrier wherein the group of elongated items recesses at least to a degree in between the two adjacent spokes of said first spoked wheel and upward toward the spoked wheel hub, said spokes of said second spoked wheel being sized and spaced from one another so as to provide a spaced distance between each of the spoke tips, with said spaced distance being sufficiently wide as to allow for at least the partial spanning by two adjacent spokes of said second spoked wheel over a group of elongated items held within a carrier wherein the group of elongated items recesses at least to a degree in between the two adjacent spokes of said second spoked wheel and upward toward the spoked wheel hub;

said carriers affixed on said conveyor means so as to be positioned for holding elongated items lengthwise transversely relative to said spoked wheels so that the exposed portion of a group of items held within a carrier may be conveyed in between spokes of said spoked wheels in synchronized rotation, a first bulk supply of flexible first banding material for supplying banding to said first spoked wheel, said first banding material extending from said first bulk supply and contacting and spanning simultaneously across the tips of a plurality of the spokes of said first spoked wheel and in part wrapping around said spoked wheel wherein said first banding material approaches in movement toward said first spoked wheel from one direction and is wrapped sufficiently to leave said first spoked wheel in a generally opposite direction of movement of its approach, tensioning means in communication with said first banding material for maintaining the banding material taut across the spoke tips, a second bulk supply of flexible second banding material for supplying banding to said second spoked wheel, said second banding material extending from said second bulk supply and contacting and spanning simultaneously across the tips of a plurality of the spokes of said second spoked wheel and in part wrapping around said spoked wheel wherein said second banding material approaches in movement toward said second spoked wheel from one direction and is wrapped sufficiently to leave said second spoked wheel in a generally opposite direction of movement of its approach, tensioning means in communication with said second banding material for maintaining the banding material taut across the spoke tips, means for affixing said first banding material to said second banding material when rotation in said first and second spoked wheels has contacted the banding materials adjacent the exposed area of a group of items within a carrier as the carrier passes through the spokes of said first and second spoked wheels one said carrier at a time wherein said first and second bandings are applied, means for severing at the affixment locations of said first and second banding materials to one another so as to leave a loop of banding material separate from said first and second banding material on said first and second spoked wheels respectively.

2. An apparatus for sequentially and tightly banding pluralities of elongated separate items into groups of items; comprising, a powered endless loop conveyor means, a plurality of item carriers in spaced relationship with one another along said conveyor means and attached to said conveyor means for movement by said conveyor means, said carriers each structured to hold a plurality of items to be banded into a single group, said carriers sized and shaped for holding the items with a portion of a group of items within each carrier exposed circumferentially so as to provide an exposed area for banding to be applied around each group of items, at least a first spoked wheel and a second spoked wheel, each spoked wheel having a plurality of radially extending spokes attached to a center hub of each spoked wheel, the spokes of said spoked wheels each having exposed spoke tips, said spoked wheels each connected to powering means for causing synchronized rotation in each of said spoked wheels with the synchronization of rotation being between both said first and second spoked wheels and additionally between movement in said conveyor means and said carriers attached to said conveyor means; said first and second spoked wheels positioned adjacent to said conveyor means and offset across from one another, said spoked wheels positioned relative to each other so that with said synchronized rotation a spoke tip of said first spoked wheel is brought into contact with a spoke tip of said second spoked wheel followed by contact of the tips being broken and two adjacent spoke tips being brought into contact in a repetitious cycle with continued synchronized rotation of said first and second spoked wheels, said spokes of said first spoked wheel being sized and spaced from one another so as to provide a spaced distance between each of the spoke tips, with said spaced distance being sufficiently wide as to allow for at least the partial spanning by two adjacent spokes of said first spoked wheel over a group of elongated items held within a carrier wherein the group of elongated items recesses at least to a degree in between the two adjacent spokes of said first spoked wheel, said spokes of said second spoked wheel being sized and spaced from one another so as to provide a spaced distance between each of the spoke tips, with said spaced distance being sufficiently wide as to allow for at least the partial spanning by two adjacent spokes of said second spoked wheel over a group of elongated items held within a carrier wherein the group of elongated items recesses at least to a degree in between the two adjacent spokes of said second spoked wheel;

said carriers affixed on said conveyor means so as to be positioned for holding elongated items lengthwise transversely relative to said spoked wheels so that the exposed of a group of items held within a carrier may be conveyed in between spokes of said spoked wheels in synchronized rotation, a first bulk supply of flexible pressure sensitive adhesive backed first banding material for supplying banding to said first spoked wheel, said first banding material extending from said first bulk supply and contacting and spanning simultaneously across the tips of a plurality of the spokes of said first spoked wheel, a second bulk supply of flexible pressure sensitive adhesive backed second banding material for supplying banding to said second spoked wheel, said second banding material extending from said second bulk supply and contacting and spanning simultaneously across the tips of a plurality of the spokes of said second spoked wheel, said pressure sensitive adhesive of said first and second bandings being means for affixing said first banding material to said second banding material when rotation in said first and second spoked wheels has contacted the banding materials via contacting spoke tips of said first and second spoked wheels carrying the banding material adjacent the exposed portion of a group of items within a carrier.

* * * * *